US005588901A

United States Patent [19]

Rubey, III et al.

[11] Patent Number: 5,588,901

[45] Date of Patent: Dec. 31, 1996

[54] CLEANING METHOD AND APPARATUS UTILIZING SODIUM BICARBONATE PARTICLES

[75] Inventors: Arthur C. Rubey, III; Andrew M. Taylor, both of San Antonio, Tex.; William E. Spears, Jr., Lawrenceville, N.J.

[73] Assignee: Yelapa Corporation, San Antonio, Tex.

[21] Appl. No.: 351,310

[22] PCT Filed: Aug. 31, 1994

[86] PCT No.: PCT/US94/09638

§ 371 Date: Dec. 14, 1994

§ 102(e) Date: Dec. 14, 1994

[87] PCT Pub. No.: WO95/06526

PCT Pub. Date: Mar. 9, 1995

Related U.S. Application Data

[63] Continuation-in-part of Ser. No. 116,405, Sep. 3, 1993, Pat. No. 5,366,560.

[51] Int. Cl.[6] ..... B24C 1/00; B24C 3/02; B24C 7/00; B24C 9/00

[52] U.S. Cl. ..... 451/99; 134/7; 134/6; 134/21; 134/38; 134/42; 451/39; 451/101

[58] Field of Search ..... 134/7, 21, 38, 134/6, 42; 51/319, 320; 451/319, 320, 39, 99, 101

[56] References Cited

U.S. PATENT DOCUMENTS

| | | | |
|---|---|---|---|
| 3,994,097 | 11/1976 | Lamb | 51/11 |
| 5,054,249 | 10/1991 | Rankin | 51/436 |
| 5,081,799 | 1/1992 | Kirschner et al. | 51/410 |
| 5,099,619 | 3/1992 | Rose | 51/436 |
| 5,160,547 | 11/1992 | Kirschner et al. | 134/7 |
| 5,230,185 | 7/1993 | Kirschner et al. | 51/410 |
| 5,366,560 | 11/1994 | Rubey, III et al. | 134/7 |

*Primary Examiner*—Zeinab El-Arini
*Attorney, Agent, or Firm*—Irving M. Fishman

[57] ABSTRACT

A method and apparatus for effecting the continuous reliable supply of sodium bicarbonate particles to a blasting nozzle employing pressured air or water for conveying such particles into contact with a surface to be cleaned. The apparatus includes a hopper at atmospheric pressure and a removable orifice through which the abrasive particles are directed from the hopper to an open ended pipe. One end of the pipe is connected to a media conveying line and a venturi passage provided in a blast nozzle whereby a pressurized fluid passing through the venturi passage creates a suction force in the conveying line and the pipe such that atmospheric air and abrasive particles are drawn from the air pipe to the blast nozzle. The amount of air flow permitted through the pipe can be adjusted by a valve to control the vacuum within the conveying line and along with the particle feeding orifice controls the concentration of abrasive particles in the air stream directed to the nozzle.

17 Claims, 3 Drawing Sheets

CLEANING METHOD AND APPARATUS UTILIZING SODIUM BICARBONATE PARTICLES

CROSS-REFERENCE TO RELATED APPLICATION

This patent application is a continuation-in-part of U.S. patent application Ser. No. 08/116,405, filed Sep. 3, 1993 now U.S. Pat. No. 5,366,560.

BACKGROUND OF THE INVENTION

1. Field of the Invention

This invention relates to the art of cleaning contamination such as old paint, grease, rust and the like from surfaces by blast cleaning. In particular, the invention is concerned with blast cleaning wherein relatively soft abrasive particles such as sodium bicarbonate particles are transported into impact engagement with the contaminated surface by a stream of pressurized air or water, and, more particularly, is concerned with novel means and methods of uniformly dispersing the soft abrasive particles into the pressurized air or water stream.

2. Summary of Prior Art

In recent years, there has been an increase in the use of cleaning systems utilizing a blast of abrasive sodium bicarbonate particles suspended in a stream of pressured air or water. Sodium bicarbonate as an abrasive blast media has distinct advantages over sand particles used for many years as the abrasive media for blast cleaning. Because of the toxic nature of sand particles (crystalline silica) when inhaled, government regulations require the use of sophisticated fresh air breathing masks to insure the health of the operator by preventing the ingestion of the silica product into the lungs. Sand blasting, moreover, cannot be economically utilized to clean softer substrates such as aluminum, plastic laminates and the like or used to blast clean machines in food processing plants because of the difficulty of removing the silica particles such as from bearing surfaces.

On the other hand, sodium bicarbonate or other like relatively soft abrasives having a Mohs hardness of less than 4.0 can effectively clean softer substrates such as aluminum or plastic components without harming the underlying surface. Importantly, sodium bicarbonate particles are reasonably soluble in water and can be readily removed by hosing down the machine and substrate after the blast cleaning. Sodium bicarbonate is not toxic and does not require elaborate fresh air breathing masks for the operator. Only standard protective clothing and ear and eye protection may be utilized. This is not necessarily a requirement but depends primarily on the substrate and the coating being removed. Sodium bicarbonate can be utilized to remove surface corrosion, lime, scale, paint, grease and machine oil from any surface, without damaging the surface and can be washed away from bearing surfaces of machinery.

Standard sand blasting equipment consists of a pressure vessel or blast pot to hold particles of sand, connected to a source of compressed air by means of a hose and having a means of metering the blasting medium from the blast pot, which operates at a pressure that is the same or slightly higher than the conveying hose pressure. The sand/compressed air mixture is transported to a nozzle where the sand particles are accelerated and directed toward a workpiece. Flow rates of the sand or other blast media are determined by the size of the equipment. Commercially available sand blasting apparatus typically employ media flow rates of 10–30 pounds per minute. About 1.2 pounds of sand are used typically with about 1.0 pound of air, thus yielding a ratio of 1.20.

As discussed above, when it is required to remove coatings such as paint or to clean surfaces such as aluminum, magnesium, plastic composites and the like, less aggressive abrasives, including inorganic salts such as sodium chloride and sodium bicarbonate can be used in conventional sand blasting equipment. The media flow rates required for the less aggressive abrasives is substantially less than that used for sand blasting, and has been determined to be from about 0.5 to about 10.0 pounds per minute, using similar equipment. This requires much lower medium to air ratio, in the range of about 0.05 to 0.40.

The employment of less aggressive abrasives such as sodium bicarbonate as a blast cleaning medium does encounter problems in effecting the transfer of the abrasive particles from a supply hopper to the nozzle from which pressured water or air issues and where the abrasive is mixed into the pressured fluid. For example difficulties have been encountered in maintaining continuous flow of sodium bicarbonate particles at the low flow-rates used for this abrasive when conventional sand blasting equipment relying on gravity feed were employed. The fine particles of a medium such as sodium bicarbonate are difficult to convey by pneumatic systems by their very nature. Further, they tend to agglomerate upon exposure to a moisture-containing atmosphere, as is typical of the compressed air used in sand blasting. In an attempt to overcome these particle delivery problems, a sodium bicarbonate crystal has been developed and marketed under the trademark "ARMEX" by Church & Dwight Co., Inc. of Princeton, N.J. A flow additive such as hydrophobic silica has been applied to the sodium bicarbonate particles to promote the flow of the resulting crystals from the hopper and into the pressured stream of air or water passing through the discharge nozzle. Even this improved particle form of sodium bicarbonate still suffers from sporadic clogging and/or inconsistent rates of delivery of the sodium bicarbonate particles to the pressurized fluid stream, which in turn leads to erratic performance.

The methods and apparatus employed for delivering sodium bicarbonate or other less aggressive abrasive media have been improved by Church & Dwight and are the subjects of U.S. Pat. Nos. 5,081,799; 5,083,402 and 5,230,185 herein incorporated by reference. Briefly, as disclosed therein a high air pressure is maintained on the top of the mass of sodium bicarbonate particles disposed in the supply hopper to maintain a differential pressure between the top of the hopper and the air conveying line which directs the abrasive particulate to the blast nozzle which accelerates the particles to the substrate surface. Further, fine control of the flow of abrasive from the hopper to the conveying line is achieved by causing the abrasive to pass through an orifice. By controlling the differential pressure and size of the orifice, fine and exact control of abrasive flow has been obtained. Under these conditions, the sodium bicarbonate particles have been found to feed uniformly and consistently into a stream of pressured air or air and injected water. However, the feeding equipment is somewhat specialized, can be relatively expensive for certain common blast cleaning applications and has not specifically addressed adding the particles to a pressurized water stream used as the primary fluid carrier to the substrate.

There is therefore still a need for an improved method and apparatus for effecting blast cleaning through the utilization of less aggressive abrasives such as sodium bicarbonate particles, whether treated with a flow promotion agent or not, which will effect a more reliable and consistent delivery of such particles to the blast nozzle and which can be conveniently adjusted to accommodate a substantial range of particle sizes of abrasives.

SUMMARY OF THE INVENTION

In accordance with this invention, improvements are provided to the method and apparatus for blast cleaning with less aggressive abrasive media such as sodium bicarbonate and, in particular, to the media delivery system which directs the abrasive particles to the pressurized air or water stream which in turn carries the abrasive particles to the surface to be treated. The apparatus of this invention comprises a hopper for containing a supply of sodium bicarbonate particles and which has a conical bottom surface terminating in a vertical flow passage. An orifice ring is removably mounted in the vertical flow passage. A plurality of such orifice rings, having different orifice sizes, are provided to insure the optimum performance of the delivery system for different sizes of sodium bicarbonate particles placed in the hopper. The invention includes alternative embodiments as to the placement of the orifice ring along the vertical flow passage. The top of the hopper is exposed to atmospheric pressure.

A pair of pipes are sealingly secured in transverse relationship to the bottom end of the vertical flow passage by a T-fitting which provides communication with such passage. Thus particles may flow by gravity into the pipes but such flow will be limited to a pile of particles filling the portion of the bores of the pipes immediately beneath the discharge passage. One of the transverse pipes is open to the atmosphere.

A blast nozzle is connected to the end of a first hose, and water under pressure, approximately 750 to 15,000 pounds per square inch, or air under a pressure of 30 to 250 psi is supplied through such hose. A venturi passage is disposed between the end of the hose and the discharge end of the blast nozzle. A transverse flow passage is provided in communication with the venturi passage adjacent to the minimum diameter portion thereof. The transverse flow passage further communicates with a second hose which is disposed with the end of one of the transverse pipes mounted on the bottom of the hopper. In operation, as the water or air under pressure is passed through the venturi passage a suction force or vacuum is generated in the transverse flow passage, the pair of pipes at the bottom of the hopper and the vertical flow passage.

The end of the transverse pipe open to the atmosphere has an air flow regulating valve connected thereto so as to permit reduction of the flow of atmospheric air through the pipe, due to the modest suction force on the order of 0.5 to 14.3 psi (1 to 29 in. Hg) produced by the connection of the second hose and transverse flow passage to the venturi passage. By proper selection of the diameter of the bore of the orifice ring and the amount of restriction of air flow into the end of the pipe below the hopper, a stream of particles will be transported to the blast nozzle which occupies not more than 25 percent of the cross-sectional area of the pipe. In effect, the moving particles constitute a fluidized bed of such particles, commonly referred to as dilute phase pneumatic conveying, within the second hose hence there is no tendency for the particles to clog or for the volume of particles to significantly vary per unit of time during delivery to the discharge nozzle.

The method and apparatus of this invention function well with the aforesaid "ARMEX" sodium bicarbonate blast media, untreated sodium bicarbonate particles, as well as other less aggressive abrasive media such as other inorganic salts or plastic media.

The size of the abrasive particles determines the size of the bore of the orifice ring. Larger particles require a larger bore diameter than do smaller particles.

Further advantages of this invention will be readily apparent to those skilled in the art from the following detailed description, taken in conjunction with the annexed sheets of drawings, on which is shown a preferred embodiment of the invention.

DESCRIPTION OF PREFERRED EMBODIMENT

Figure 1:
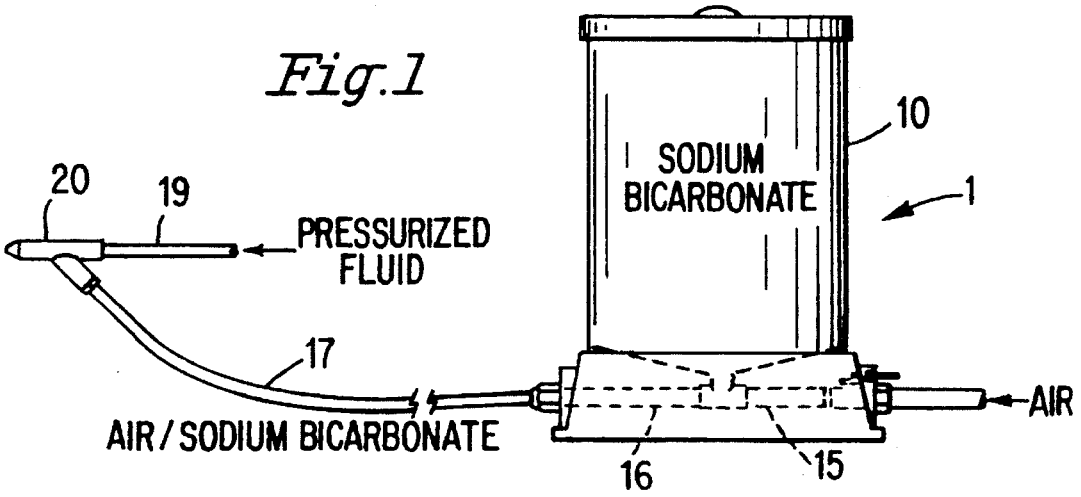
FIG. 1 is a schematic view of the apparatus embodying this invention.
Figure 2:
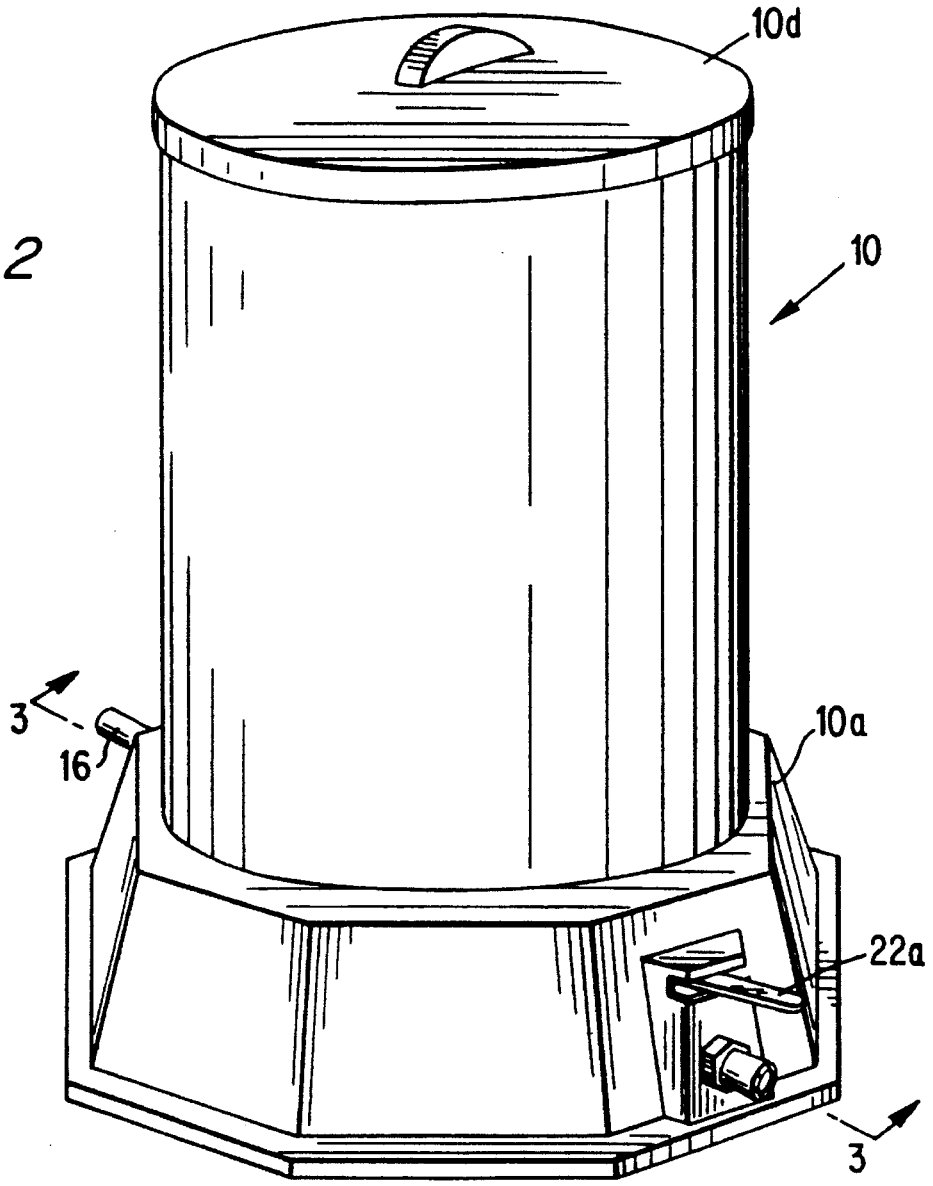
FIG. 2 is a perspective view of a hopper for containing abrasive media and the mechanism for metering the flow rate of the abrasive particles out of the hopper.

Referring to FIGS. 1, 2, 3 and 5, the apparatus 1 embodying this invention comprises a container 10 for sodium bicarbonate abrasive particles P and the like. Container 10 is mounted on an annular base portion 10*a*, and has a conically shaped, inwardly sloping bottom wall, 10*b*, terminating in a central aperture 10*c*.

While a preferred blast media is sodium bicarbonate, other blast media such as potassium bicarbonate, ammonium bicarbonate, sodium chloride, sodium sulfate and other water-soluble salts or mixtures thereof, are meant to be included herein. Non-water soluble materials such as calcium carbonate are also useful. Also included are mixtures of such less aggressive media with more aggressive materials, such as, aluminum oxide, which is water insoluble, especially where precise flow control is necessary.

The abrasive blast media particles useful in this invention will generally range from about 50 to 2,000 microns depending on the abrasive used. Particle sizes of 50 to 1,000 microns are more common. Preferred sizes for sodium bicarbonate particles range from 50–500 microns. The selection of the size of the abrasive media is based on the particular application.

A hollow bolt 12 having a shank portion 12*a*, projects through the aperture 10*c* and threadably engages the shank portion 13*a* of an ordinary T-shaped pipe fitting 13. The size of the vertical discharge passage for the particles P is determined by selecting one of a plurality of tubular orifices 11, which are threadably secured to internal threads 12*c*, provided in the bolt 12. A sealing washer 14 is provided between the bottom wall 10*b* of the hopper and the end of the shank portion 13*a* of the pipe fitting 13. Each tubular orifice element 11 has a different size discharge passage 11*a* formed therein, thus regulating the flow rate of the particles of sodium bicarbonate or other abrasive into the T-shaped pipe fitting 13.

For larger abrasive particles, the selected orifice 11 would have a larger passage 11*a* than for smaller particles of abrasive. A cover 10*d* is provided for the top of the hopper 10, but this cover is merely for the purpose of preventing dirt from falling into the supply of sodium bicarbonate particles and is not airtight, thus exposing the particles within the hopper 10 to atmospheric pressure.

The lateral ends of the T-shaped pipe coupling 13 are respectively threadably connected to an air inlet pipe 15 and a suction pipe 16, both of which are disposed within the hollow interior of the base 10*a*. In effect, the head portion 13*b* of the T-shaped coupling 12 and the pipes 15 and 16 may be considered to be a continuous pipe which is transversely connected to the orifice 11*a*, through which particles P may flow into the continuous pipe.

Figure 4:
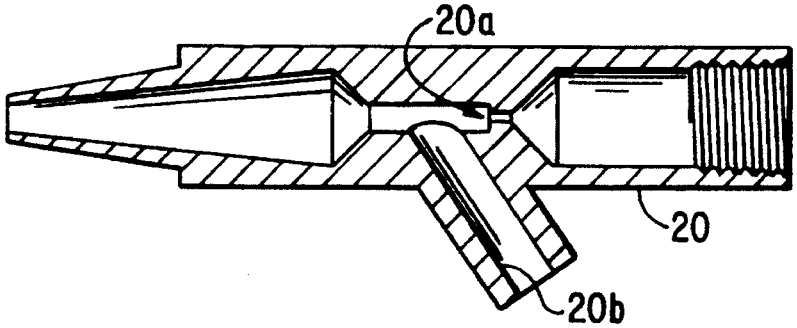
FIG. 4 is a sectional view of a conventional venturi utilized in the blasting nozzle.

As best shown in FIG. 1, the air suction pipe 16 is connected by a hose 17 to a discharge nozzle element 20 connected to the end of a supply hose 19 for supplying pressured air or water to the nozzle 20. As best shown in FIGS. 1 and 4, the hose 17 and suction pipe 16 communicate with a transverse fluid passage 20*b* in the nozzle 20. Transverse fluid passage 20*b* communicates with venturi passage 20*a*, defined within nozzle 20. The suction pipe 16 is subjected to a suction pressure or vacuum produced by the discharge of pressured fluid supplied by hose 19 through venturi 20*a*.

The air inlet pipe 15 is provided with a conventional adjustable flow valve 22, by which the amount of air sucked into the pipe 15 by the suction produced by the venturi passage 20*a* in blast nozzle 20 may be adjusted. An unexpected feature of the apparatus embodying this invention is the fact that if the valve 22 is shifted by its operating handle 22*a* to a fully closed position, the entire suction pressure generated by the venturi passage 20*a* is applied to the bottom of the hopper full of particles P. Under this condition, the particles P will not flow continuously through the selected aperture 11*a* of the orifice 11, but will tend to move in clumps, which often results in the plugging of the air suction pipe 16 and/or hose 17.

For the successful operation of the apparatus, the amount of inlet air permitted for passage through pipe 15 by the valve 22 is correlated with the size of orifice passage 11*a*, so as to produce a volume flow of particles P which at all times occupies up to 25 percent of the cross-sectional area of the pipe 16 and hose 17. When the hose 16 is fabricated from a transparent plastic material, the particles P can be observed as a distinct stream, similar to a fluidized bed, generally moving along the bottom surface of the hose 16 and, as stated above, occupying a minor portion of the cross-sectional area of such hose. Under these conditions, no clogging of the abrasive particles occurs.

The suction pressure applied to the abrasive particles P varies, of course, with the pressure of the air or water supplied to the nozzle 20. For most applications, a suction pressure on the order of 0.5 to 14.3 pounds per square inch (1 to 29 inch Hg) will produce a satisfactory feeding of the abrasive particles P from the hopper 10 into the pipe 13. Preferably a suction pressure or vacuum 1 to 7.5 psi of (2 to 15 inch Hg) is applied to deliver the abrasive. This amount of suction pressure is readily obtained when the pressurized fluid applied to the nozzle 20 by hose 19 is maintained at a conventional level of 750 to 15,000 pounds per square inch for water and 30 to 100 psi for air. In no case, should suction pressure be applied to the abrasive particles P to produce a filling of the cross-section area of the pipe 16 and/or the hose 17. The size of discharge opening 11*a* in tubular orifice 11 will typically range from about 0.09 to 0.250 inch, preferably from about 0.110 to 0.219 inch. As previously stated, the size of the discharge opening 11*a* selected will depend upon the size of the abrasive media particles to be used.

All of the factors which determine the media flow rate through the blast nozzle including particle size, the size of the discharge opening in the orifice ring, the pressure of the fluid carrier stream through the nozzle, the vacuum applied under the hopper and the amount of atmospheric air allowed into the vacuum lines to control the vacuum are interdependent so as to maintain the conveying velocity of the air and the fluidization of the abrasive particles through pipe 16 and hose 17 to the nozzle. During the blast cleaning process, it would be worthwhile to be able to manipulate only one of the operational variables and still accurately control the delivery of the abrasive to the nozzle and maintain the optimum blast cleaning performance. It has been found that it is best as well as easiest to control the amount of atmospheric air allowed into pipe 15 by controlling valve 22 during blast cleaning to control abrasive particle delivery to the blast nozzle. However, precise control of the media flow rate cannot be readily obtained even by experience if there is no way to correlate the amount of vacuum needed to deliver a particular abrasive media at a given carrier fluid pressure at the blast nozzle. Thus, if there is no means for the operator to determine the operational vacuum, there is no means to accurately and very finely control the amount of atmospheric air allowed into and passing through pipe 15 to precisely control particle flow rate. Thus, inefficiencies in the delivery system are observed only when the blast cleaning performance is adversely affected.

Figure 5:
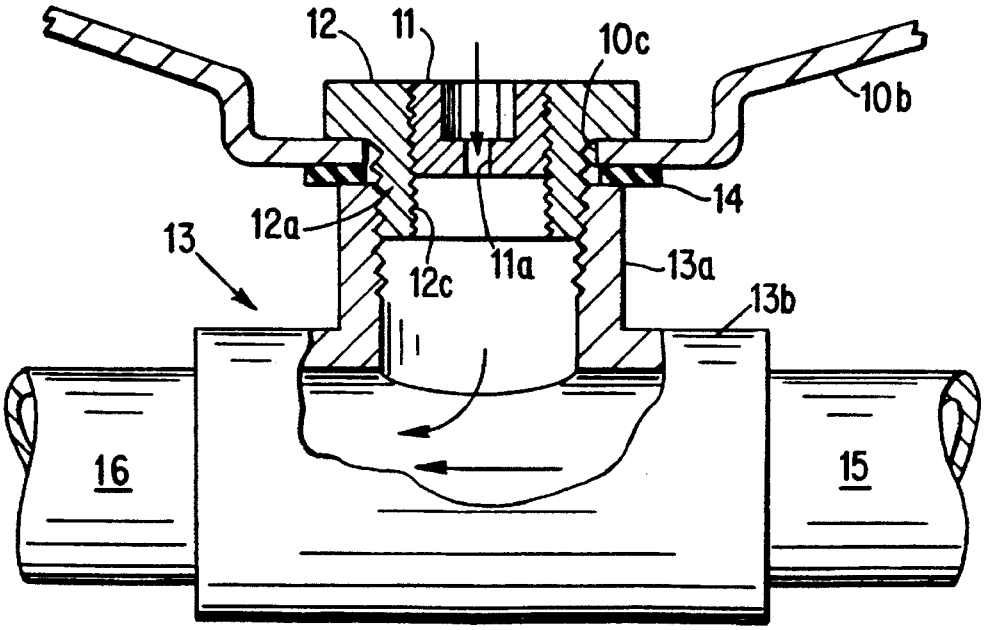
FIG. 5 is an enlarged-vertical sectional view of the discharge portion of the apparatus of this invention including the hopper, the orifice ring and vertical flow passage.

Additionally, the media delivery system such as shown in FIG. 5 while fully achieving the advantages described for the invention cannot be readily changed during a particular blast cleaning operation. Thus, to change the orifice ring 11, the hopper must be substantially devoid of the abrasive particles. An alternative embodiment of the abrasive particle discharge portion of the invention is shown in FIG. 6 and alleviates some of the inconveniences described immediately above.

Figure 6:
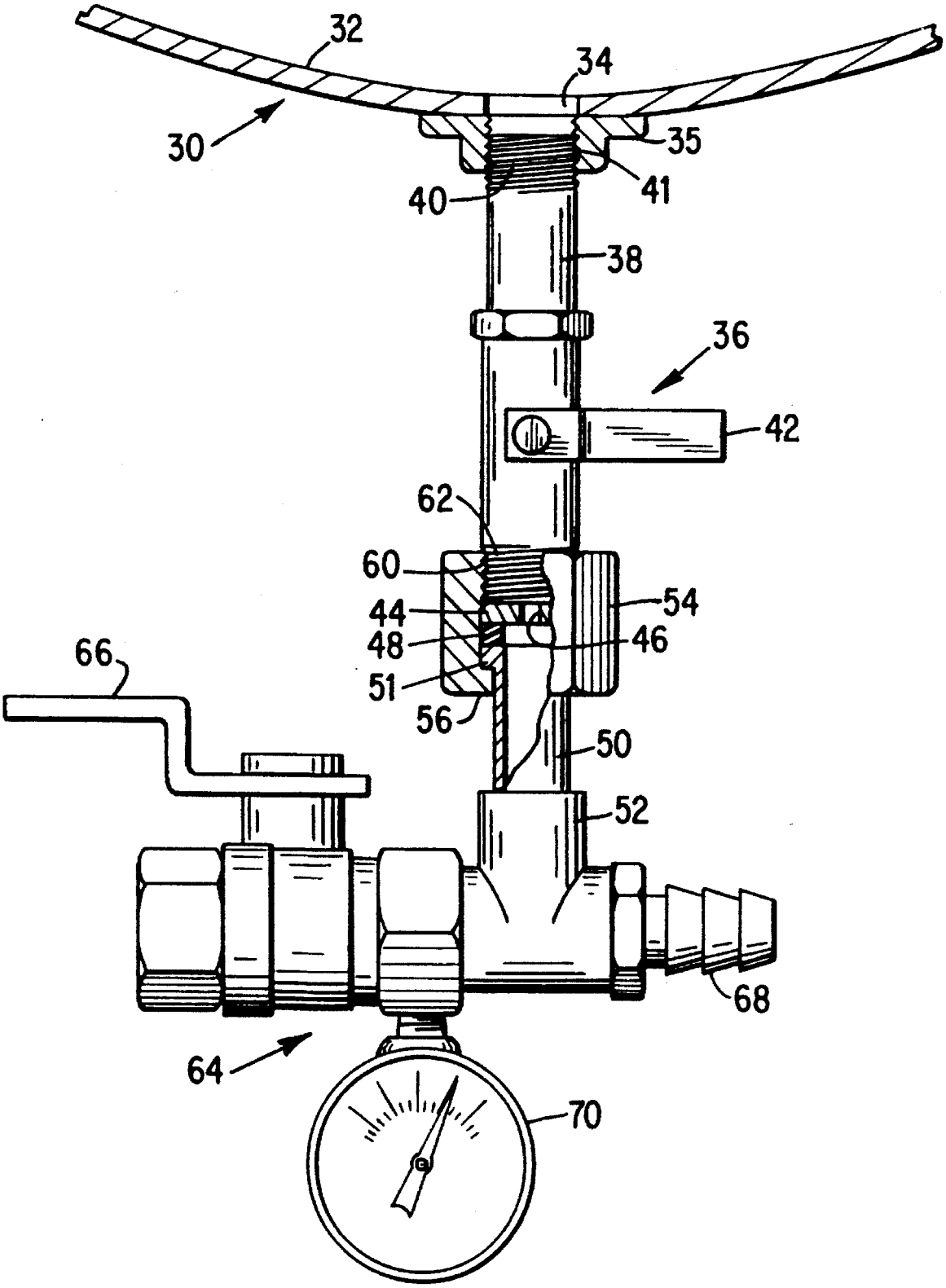
FIG. 6 is an enlarged vertical sectional view of an alternative embodiment of the discharge portion of the apparatus of this invention.

Referring to FIG. 6, it can be seen that the alternative media delivery system includes a hopper 30 having a conically shaped, inwardly sloping bottom wall 32 and a central aperture 34 equivalent to the hopper 10 of the embodiment shown in FIGS. 1–5. Threaded into boss 35 welded to the bottom of hopper 30 and contiguous with central aperture 34 is an on/off valve 36 such as a ball valve or the like. Valve 36 includes a pipe nipple 38 containing external threads 40 which can be threaded onto the internal threads 41 of boss 35. Any other conventional means can be used to attach valve 36 to hopper 30, e.g. welding, as long as aperture 34 is not excessively restricted. A handle 42 can be moved to place the typical ball valve in the on or off position whereby in the "on" position the media flows from hopper 30 through pipe nipple 38 and through a passage in the movable ball in valve 36 whereas in the "off" position, the passage in the movable ball is not in alignment with aperture 34 and accordingly the media particles cannot flow through the valve.

Downstream of valve 36 is orifice ring 44 which includes discharge opening 46 to precisely control the volume of media flowing from hopper 30 to the blast nozzle. Orifice ring 44 rests upon a seal 48. In turn, seal 48 rests on the outer circumferential edge of flange 51 of a pipe fitting 50 which is threaded at the end opposite flange 51 into T-shaped pipe fitting 52. To secure orifice ring 44 and seal 48 in place, a slidable nut 54 which has a bottom edge 56 slidable around pipe fitting 50 and capable of engagement with flange 51 of pipe fitting 50 and includes upper internal threads 60 is threaded onto external threads 62 placed at the bottom of valve 36. As nut 54 is threaded onto valve 36, nut 54 brings into a tight sealing engagement the bottom of valve 36, orifice ring 44, seal 48 and flange 51 of pipe fitting 50. To change the size of discharge opening 46, nut 54 is simply unthreaded from valve 36 and slid down on pipe fitting 50 to reveal orifice ring 44. Orifice ring 44 can then be replaced with a different orifice ring and nut 54 again threaded into tight engagement with valve 36. By incorporating an on/off valve 36 between the hopper 30 and the orifice ring 44, the orifice ring can be changed without the need to empty the hopper of the abrasive particles.

Figure 3:
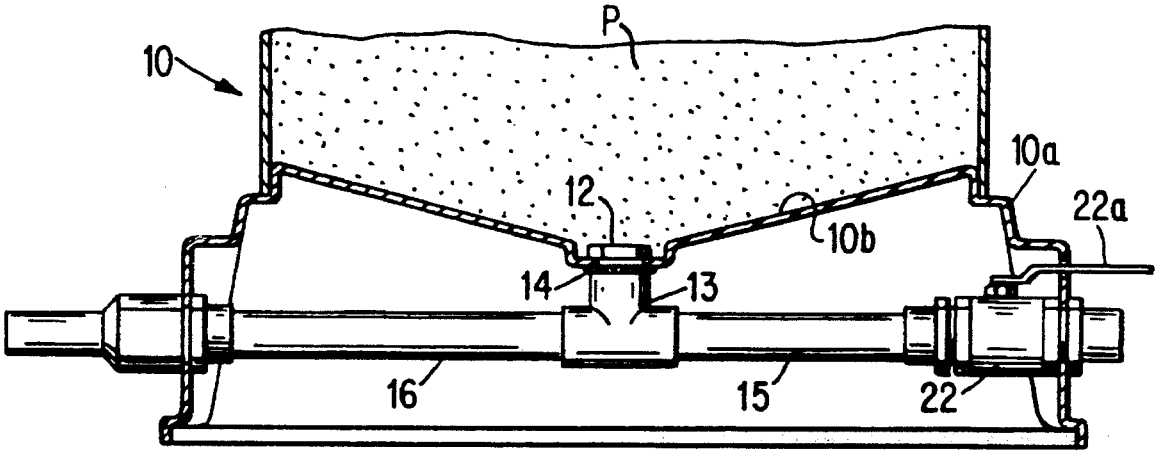
FIG. 3 is a partial sectional view taken on the Plane 3—3 of FIG. 2.

The lateral flow areas on each side of the T-fitting 52 are substantially equivalent to that shown in FIGS. 3 and 5. Thus, connected to one end of T-fitting 52 is a conventional air flow valve 64 such as a ball valve or the like and including a handle 66 which can be manipulated to control the amount of atmospheric air allowed into and flowing through the T-fitting 52 and through lateral pipe connection, shown as hose coupling 68, which forms the abrasive delivery line to the blast nozzle in the equivalent manner as provided by pipe 16, hose 17 and blast nozzle 20 shown in FIG. 1.

To allow the operator to precisely control the delivery of the media to the blast nozzle and, importantly, to provide consistent control over time, it would be preferred that the operator know the precise vacuum being applied to the system during the operation of the nozzle so that with a particular media, the amount of atmospheric air being allowed to flow through the system such as through valve 64 can be controlled to yield the optimum performance. Thus, in the media delivery system shown in FIG. 6, a vacuum gauge 70 is placed and tapped into T-fitting 52 upstream of the point where the media is discharged into T-fitting 52. During blast cleaning the precise vacuum in the system can be read by the operator and the valve 64 can be controlled continuously to provide and maintain the desired vacuum. Over time, experience will allow the operator to know which vacuum level operates best with a particular media allowing the operator to simply control the volume flow of atmospheric air by controlling valve 64 to maintain the desired vacuum which can be read from gauge 70. Disruption of the vacuum can now be corrected to maintain the desired flow of abrasive before such disruption results in uneven blast cleaning performance. With a particular blast media, a known size of the orifice ring opening 46, and the vacuum level measured via gauge 70, the flow rate of media can be readily determined.

EXAMPLE

The media flow rate of abrasive media through a blast nozzle utilizing the media discharge system as shown in FIG. 6 was tested utilizing different orifice ring sizes and varying the vacuum applied to the system. In each case, water at a pressure of around 1500 psig was passed through the blast nozzle. In Table 1, the particle size of the sodium bicarbonate particles was about 300 microns and in Table 2, the sodium bicarbonate media had an average size of about 170 microns. Media flow rates ranging from 0.4 to 4 lbs per minute are preferred.

TABLE 1

| Media Type | Sodium bicarbonate (300 microns) Media Orifice Size, Inch | | | | |
|---|---|---|---|---|---|
| Vacuum, in. Hg | 0.219 | 0.187 | 0.157 | 0.125 | 0.110 |
| | Media Flow lbs/min | | | | |
| 2 | 1.2 | 0.9 | 0.6 | 0.5 | 0.3 |
| 4 | 1.6 | 1.2 | 0.8 | 0.6 | 0.4 |
| 6 | 1.9 | 1.4 | 1.0 | 0.8 | 0.5 |
| 8 | 2.2 | 1.6 | 1.2 | 0.9 | 0.6 |
| 10 | 2.7 | 2.0 | 1.4 | 1.1 | 0.8 |
| 12 | 3.0 | 2.2 | 1.6 | 1.2 | 0.9 |
| 14 | 3.3 | 2.4 | 1.8 | 1.3 | 1.0 |
| 16 | 3.6 | 2.6 | 2.0 | 1.4 | |
| 18 | 3.8 | 2.8 | 2.2 | | |
| 20 | 4.1 | 3.0 | | | |

TABLE 2

| Media Type | Sodium bicarbonate (170 microns) Media Orifice Size, Inch | | | | |
|---|---|---|---|---|---|
| Vacuum, in. Hg | 0.219 | 0.187 | 0.157 | 0.125 | 0.110 |
| | Media Flow lbs/min | | | | |
| 2 | 1.6 | 1.2 | 0.9 | 0.7 | 0.5 |
| 4 | 2.2 | 1.6 | 1.1 | 0.9 | 0.6 |
| 6 | 2.5 | 1.8 | 1.3 | 1.1 | 0.7 |
| 8 | 2.7 | 2.0 | 1.6 | 1.2 | 0.8 |
| 10 | 3.3 | 2.4 | 1.8 | 1.4 | 1.0 |
| 12 | 3.6 | 2.7 | 2.0 | 1.6 | 1.1 |
| 14 | 3.9 | 3.0 | 2.2 | 1.8 | 1.2 |
| 16 | 4.2 | 3.3 | 2.4 | 2.0 | |
| 18 | 4.5 | 3.6 | 2.6 | | |
| 20 | 4.9 | | | | |

What is claimed is:

1. Apparatus for cleaning a surface by blasting the surface with particles of abrasive entrained in a high velocity fluid stream comprising, in combination:

a hopper for containing abrasive particles, said hopper having a top and a tapered bottom surface terminating in a vertical passage, the top of said hopper being exposed to atmospheric pressure;

an orifice element removably mounted in said vertical passage defining an orifice bore of selected diameter to allow passage of the abrasive particles therethrough;

an air pipe having a first end and a second end;

a bore transversely intersecting said vertical passage below said orifice element, said transversely intersecting bore being disposed to receive abrasive particles passing through said orifice bore, said transversely intersecting bore being further disposed in communication with said air pipe;

said first end of said air pipe communicating with atmospheric air, said first end of said air pipe being disposed upstream of said transversely intersecting bore;

an applicating nozzle;

means defining a venturi passage connected to said applicating nozzle;

first hose means for supplying a stream of pressurized fluid through said venturi passage;

means defining a suction fluid passage communicating with said venturi passage to produce a suction force; and second hose means connecting said suction fluid passage to said second end of said air pipe.

2. The apparatus of claim 1 further comprising means on said first end of said air pipe to vary atmospheric air flow through said air pipe.

3. The apparatus of claim 2 wherein said means to vary atmospheric air flow comprises a valve.

4. The apparatus of claim 1 wherein said venturi passage is contained in said applicating nozzle.

5. The apparatus of claim 4 wherein said suction fluid passage communicates transversely with said venturi passage in said applicating nozzle.

6. The apparatus of claim 1 wherein said orifice element is removably mounted in the bottom of said hopper.

7. The apparatus of claim 1 wherein said orifice element is removably mounted in said vertical passage intermediate the bottom of said hopper and said air pipe.

8. The apparatus of claim 7 further including a means to prevent flow of abrasive particles from the bottom of said hopper into said orifice element.

9. The apparatus of claim 8 wherein said means to prevent flow of abrasive particles comprises a valve interposed between the bottom surface of said hopper and said orifice element.

10. The apparatus of claim 1 further including a gauge to measure and indicate a vacuum formed in said suction fluid passage.

11. The apparatus of claim 10 wherein said gauge is placed in said air pipe at a region of said air pipe which is upstream of where said transversely intersecting bore transversely intersects said vertical passage.

12. A discharge apparatus for feeding particles of an abrasive to a blast nozzle comprising a hopper for containing abrasive particles, said hopper having a top and a tapered bottom surface terminating in a vertical passage, the top of said hopper being exposed to atmospheric pressure;

an orifice element removably mounted in said vertical passage defining an orifice bore of selected diameter to allow passage of the abrasive particles therethrough;

an air pipe having a first end and a second end;

a bore transversely intersecting said vertical passage below said orifice element, said transversely intersecting bore being disposed to receive abrasive particles passing through said orifice bore, said transversely intersecting bore being further disposed in communication with said air pipe;

said first end of said air pipe communicating with atmospheric air, said first end of said air pipe being disposed upstream of said transversely intersecting bore, and said second end of said air pipe being connected to a vacuum application means.

13. The discharge apparatus of claim 12 further comprising means on said first end of said air pipe to vary atmospheric air flow through said air pipe.

14. The discharge apparatus of claim 13 wherein said means to vary atmospheric air flow comprises a valve.

15. The discharge apparatus of claim 12 wherein said orifice element is removably mounted in said vertical passage intermediate the bottom of said hopper and said air pipe.

16. The discharge apparatus of claim 15 including a valve means interposed between the bottom of said hopper and said orifice element so as to allow the prevention of flow of abrasive particles from the bottom of said hopper into said orifice element.

17. The discharge apparatus of claim 12 further including a gauge to measure and indicate the vacuum formed at said second end of said air pipe.

* * * * *